US009080221B2

(12) United States Patent
Kearney et al.

(10) Patent No.: US 9,080,221 B2
(45) Date of Patent: Jul. 14, 2015

(54) SYSTEM AND PROCESS FOR REFINING SUGAR

(71) Applicant: Amalgamated Research LLC, Wilmington, DE (US)

(72) Inventors: Michael M. Kearney, Twin Falls, ID (US); Alan W. Hieb, Boise, ID (US); Timothy E. Pryor, Twin Falls, ID (US); Lawrence Velasquez, Twin Falls, ID (US)

(73) Assignee: AMALGAMATED RESEARCH LLC, Wilmington, DE (US)

( * ) Notice: Subject to any disclaimer, the term of this patent is extended or adjusted under 35 U.S.C. 154(b) by 410 days.

(21) Appl. No.: 13/684,798

(22) Filed: Nov. 26, 2012

(65) Prior Publication Data

US 2013/0139811 A1 Jun. 6, 2013

Related U.S. Application Data

(60) Provisional application No. 61/566,307, filed on Dec. 2, 2011.

(51) Int. Cl.

| | |
|---|---|
| ***C13B 50/00*** | (2011.01) |
| ***C13B 20/14*** | (2011.01) |
| ***C13B 30/04*** | (2011.01) |
| ***C13B 30/14*** | (2011.01) |
| ***C13B 35/06*** | (2011.01) |

(52) U.S. Cl.

CPC ..... *C13B 50/00* (2013.01); *C13B 20/14* (2013.01); *C13B 30/04* (2013.01); *C13B 30/14* (2013.01); *C13B 35/06* (2013.01)

(58) Field of Classification Search

CPC ..... C13B 50/00; C13B 30/04; C13B 35/06; C13B 30/14

See application file for complete search history.

(56) References Cited

U.S. PATENT DOCUMENTS

| | | | |
|---|---|---|---|
| 5,102,553 | A | 4/1992 | Kearney et al. |
| 5,865,899 | A | 2/1999 | Theoleyre et al. |
| 6,093,326 | A | 7/2000 | Heikkila et al. |
| 6,187,204 | B1 | 2/2001 | Heikkild et al. |
| 6,379,554 | B1 | 4/2002 | Kearney et al. |
| 7,390,408 | B2 | 6/2008 | Kearney et al. |
| 2010/0160624 | A1 | 6/2010 | Cunningham |

FOREIGN PATENT DOCUMENTS

| | | |
|---|---|---|
| WO | WO-96/25522 | 8/1996 |
| WO | WO-00/60128 | 10/2000 |
| WO | WO-2004/108969 A1 | 12/2004 |

OTHER PUBLICATIONS

International Search Report and Written Opinion dated Mar. 19, 2013 from International Application No. PCT/US2012/066634.

*Primary Examiner* — David A Reifsnyder

(74) *Attorney, Agent, or Firm* — David D. Brush; Westman, Champlin & Koehler, P.A.

(57) ABSTRACT

A system and process for refining raw sugar, comprising a melting unit configured to receive the raw sugar and an eluent to produce a melt liquor, a decolorization unit configured to receive the melt liquor and to produce a fine liquor, a crystallization unit configured to fractionate high-purity crystalline sucrose from the fine liquor and to provide a run-off syrup, a softening unit configured to receive the run-off syrup to produce a softened syrup, at least one separation unit configured to receive the softened syrup to produce a low-invert sucrose product, and a recycle line configured to relay the low-invert sucrose product from the at least one separation unit to the melting unit.

20 Claims, 2 Drawing Sheets

SYSTEM AND PROCESS FOR REFINING SUGAR

CROSS-REFERENCE TO RELATED APPLICATION(S)

The present application claims priority to U.S. Provisional Application No. 61/566,307, filed on Dec. 2, 2011, and entitled "SYSTEM AND PROCESS FOR REFINING SUGAR", the disclosure of which is incorporated by reference in its entirety.

FIELD

The present disclosure relates to a system and process for refining raw sugar to crystalline white sugar.

BACKGROUND

The main goal of a raw sugar refinery is to economically convert raw sugar into a safe and marketable product for human consumption. Numerous and varied unit processes are utilized to achieve this goal. Crystallization is one of these major unit processes.

The typical refinery treats purified fine/white liquor with several crystallization "strikes" that produce a combined saleable product. Due to the recovery/removal of sugar out of the fine liquor feed, the non-sucrose impurities increase in concentration in the strike run-off syrups. As a result, production of final product quality sugar via crystallization becomes cost ineffective. The residual run-off syrup (also referred to as residual refined syrup) sucrose content is relatively high and without further sugar recovery, results in significant sugar recovery income losses.

The traditional process to reduce the sugar losses in the residual run-off syrup utilizes a recovery house. The recovery house basically utilizes crystallization in order to produce an acceptable raw sugar quality that is fed back into the raw sugar melter unit of the refinery. There are numerous techniques utilized in recovery house designs, but all utilize the energy and the equipment intensive process of evaporative crystallization and centrifugation.

SUMMARY

An aspect of the present disclosure is directed to a system for refining raw sugar. The system includes a melting unit configured to receive the raw sugar and an eluent to produce a melt liquor, a decolorization unit configured to receive the melt liquor and to produce a fine liquor, and a crystallization unit configured to fractionate high-purity crystalline sucrose from the fine liquor and to provide a run-off syrup. The system also includes a softening unit configured to receive the run-off syrup to produce a softened syrup, at least one separation unit (e.g., chromatography unit) configured to receive the softened syrup to produce a low-invert sucrose product, and a recycle line configured to relay the low-invert sucrose product from the at least one separation unit to the melting unit.

Another aspect of the present disclosure is directed to a system for refining raw sugar, which includes a melting unit configured to receive the raw sugar and an eluent to produce a melt liquor, a first unit configured to receive the melt liquor and to produce a fine liquor, and a crystallization unit configured to fractionate high-purity crystalline sucrose from the fine liquor and to provide a run-off syrup comprising invert compounds, non-fractionated sucrose, and divalent cations.

The system also includes a second unit configured to receive the run-off syrup and to remove at least a portion of the divalent cations from the run-off syrup to produce a softened syrup, at least one separation unit (e.g., chromatography unit) configured to receive the softened syrup and to fractionate at least a portion of the invert compounds from the received softened syrup to produce a low-invert sucrose product, and a recycle line configured to relay the low-invert sucrose product from the at least one separation unit to the melting unit.

Another aspect of the present disclosure is directed to a method for refining raw sugar. The method includes combining the raw sugar and an eluent to produce a melt liquor having a color level, reducing the color level of the melt liquor to produce a fine liquor, and fractionating sucrose from the fine liquor to produce high-purity crystalline sucrose and a run-off syrup. The method also includes removing at least a portion of divalent cations from the run-off syrup to produce a softened syrup, removing at least a portion of invert compounds from the softened syrup using a differential migration through an ion exchange resin to produce a low-invert sucrose product an invert compounds, and combining the low-invert sucrose product with subsequent amounts of the raw sugar and the eluent.

DETAILED DESCRIPTION

The present disclosure is directed to a raw sugar refining system and process for producing high-quality sucrose with high levels of recovery. As discussed below, the process includes a combination of an ion exchange step and a chromatography step to recover a low-invert sucrose product, and to recycle the sucrose product back to a front end of the process. The use of this combination for recovering the sucrose product effectively eliminates the need for a conventional recovery house, which typically uses an energy and equipment-intensive process.

Figure 1:
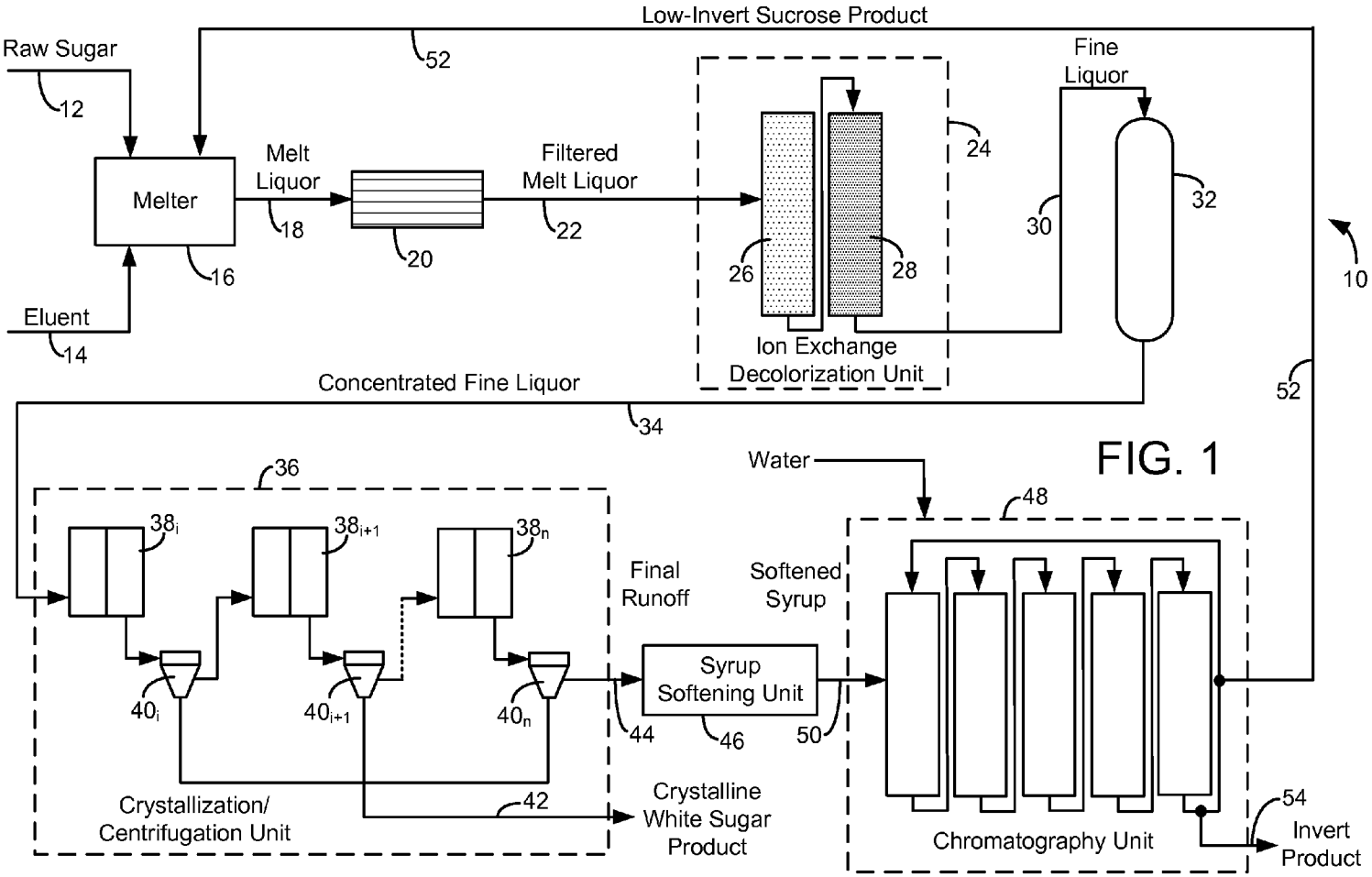
FIG. 1 is a block diagram of a raw sugar refining system of the present disclosure.

FIG. 1 illustrates system 10 for producing high-quality sucrose with high levels of recovery from raw sugar. As shown, system 10 includes raw sugar line 12, eluent line 14, and melter 16, where raw sugar line 12 may be any suitable mechanism for conveying raw sugar to melter 16 (e.g., a supply hopper and auger system, not shown). The raw sugar typically has a purity of sucrose sugar crystals ranging from about 97.0% by weight to about 99.9% by weight, the remaining portion of the raw sugar being unwanted impurities that coat the surfaces of the sucrose sugar crystals.

In one embodiment, prior to reaching melter 16, the raw sugar may also undergo an affination process to assist in the removal of the impurities from the sugar crystals. The affination process involves mixing the raw sugar with a heated concentrated syrup to soften the impurity coatings on the sucrose sugar crystals. The syrup is then separated from the raw sugar, such as by centrifugation.

At melter 16, the raw sugar is dissolved in an eluent (e.g., water or refinery sweetwater) from eluent line 14, and heated to provide a melt liquor that exits melter 16 through fluid line 18. Suitable dry solids concentrations of the raw sugar in the eluent for the melt liquor range from about 50% by weight to about 75% by weight. In some embodiments, suitable dry solids concentrations of the raw sugar in the eluent for the melt liquor range from about 60% by weight to about 70% by weight (e.g., about 65% by weight).

The melt liquor is then passed through filter unit 20, which includes one or more filters configured to remove undissolved solid particulates and a portion of the color from the melt liquor. The resulting filtered melt liquor is then fed through fluid line 22 to ion exchange decolorization unit 24, which is one or more ion exchange columns that desirably contain one or more strong anion exchange resins. For example, ion exchange decolorization unit 24 may include a first column or first series of columns (e.g., column 26) containing a first anion exchange resin(s) (e.g., an acrylic anion decolorizer), and a second column or second series of columns (e.g., column 28) containing a second anion exchange resin(s) (e.g., a styrenic anion decolorizer). Ion exchange decolorization unit 24 removes colorant impurities from the melt liquor from fluid line 22, thereby lightening the color from a brown color to a whitish color.

The operating parameters of ion exchange decolorization unit 24 may vary depending on various processing factors, such as the flow rate and composition of the melt liquor from fluid line 22. Examples of suitable operating parameters for column 26 of ion exchange decolorization unit 24 include a bed exhaustion rate of about three bed volumes per hour (bv/hr), with an exhaustion temperature of about 80° C., and with a regenerant of a 10% sodium chloride (NaCl) and 1% sodium hydroxide (NaOH) solution in water with a suitable regenerant temperature. Suitable regenerant temperatures may vary over a large temperature variation, and may range from about 25° C. to about 75° C. Examples of resins for column 26 include strong anion resins, such as an acrylic anion decolorizer commercially available under the trade name "LANXESS" S 5428" from Lanxess Corporation, Birmingham, N.J.; and similar ion exchange resin products.

Examples of suitable operating parameters for column 28 of ion exchange decolorization unit 24 include a bed exhaustion rate of about three bed volumes per hour (bv/hr), with an exhaustion temperature of about 80° C., and with a regenerant of a 10% sodium chloride (NaCl) and 1% sodium hydroxide (NaOH) solution in water with a suitable regenerant temperature (e.g., from about 25° C. to about 75° C.). Examples of resins for column 28 include strong anion resins, such as a styrenic anion decolorizer commercially available under the trade name "LANXESS" S 6368" from Lanxess Corporation, Birmingham, N.J., and similar ion exchange resin products.

The resulting fine liquor is then fed through fluid line 30 to evaporation system 32, which is configured to increase the solids concentration of the sucrose sugar crystals in the eluent, such as by boiling off a portion of the eluent. The resulting concentrated fine liquor that exits evaporation system 32 through fluid line 34 may have dry solids concentration ranging from about 70% by weight to about 75% by weight.

The concentrated fine liquor is then fed through fluid line 34 to crystallization/centrifugation unit 36, which is a multiple-strike crystallization and centrifugation unit configured to crystallize and separate the desired white sugar product from the impurity-containing eluent. For example, crystallization/centrifugation unit 36 may include a series of paired vacuum pans and centrifugation units (e.g., vacuum pans $\mathbf{38}_i$, $\mathbf{38}_{i+1}$, . . . $\mathbf{38}_n$ and centrifugation units $\mathbf{40}_i$, $\mathbf{40}_{i+1}$, . . . , $\mathbf{40}_n$). In this embodiment, concentrated fine liquor 34 is fed to vacuum pan 38*i*, where it is concentrated, seeded with fine sugar, and fed under a sugar-saturated condition to allow sucrose crystals to grow and separate from the resulting syrup. The resulting fillmass is then directed to centrifugation unit 40*i*, where the sucrose crystals are separated from the resulting mother liquor or run-off syrup.

The sucrose crystals are then relayed from centrifugation unit 40*i* via product line 42 and dried to provide the desired crystalline white sugar product. At this point in the process, the mother liquor is transferred to vacuum pan $\mathbf{38}_{i+1}$. The mother liquor entering vacuum pan $\mathbf{38}_{i+1}$ has a lower concentration of sucrose compared to the concentrated fine liquor from fluid line 34 due to the crystallization and separation of the sucrose crystals.

However, the mother liquor still retains an economically-valuable amount of sucrose. As such, multiple crystallization and centrifugation strikes may be performed in a serial manner in vacuum pans $\mathbf{38}_{i+1}$ . . . $\mathbf{38}_n$ and centrifugation units $\mathbf{40}_{i+1}$ . . . $\mathbf{40}_n$. The separated sucrose crystals from each centrifugation unit are then transferred along product line 42, and dried to provide further amounts of the desired crystalline white sugar product. During each crystallization step, the concentration of sucrose in the mother liquor decreases. This may continue until no additional sucrose can be obtained, such as due to solubility constraints, if the resulting sugar is too poor quality for product or recirculation, and/or due to economic reasons. Examples of suitable numbers of pairs of vacuum pans and centrifugation units range from one to ten, with particularly suitable numbers ranging from three to five.

The desired crystalline white sugar product from product line 42 may then undergo one or more post-production steps and then be packaged for consumer use. On the other hand, the final run-off syrup or mother liquor exits crystallization/centrifugation unit 36 through fluid line 44 to syrup softening unit 46. Syrup softening unit 46 is configured to remove divalent cations, such as calcium and magnesium ions from the final syrup. This increases the efficiency of the subsequent chromatography step in chromatography unit 48, which otherwise may not function as efficiently with syrup containing high levels of divalent cations.

In embodiments in which the monovalent background of the syrup from fluid line 44 exceeds 15 milliequivalents/100 grams of dissolved solids, then syrup softening unit 46 may incorporate a weak cation softener. Alternatively, in embodiments in which the monovalent background of the syrup from fluid line 44 does not exceed 15 milliequivalents/100 grams of dissolved solids, then syrup softening unit 46 may incorporate a strong cation softener.

The reason for this distinction is that as the monovalent concentration in the syrup increases, a strong cation resin will tend to be regenerated by the monovalents rather than obtaining the desired divalent softening. While the strong cation softener is regenerated with a solution of NaCl, the weak cation softener requires a multiple regeneration consisting of an acid regeneration to remove the divalent cations followed by a caustic regeneration to convert the resin to monovalent form.

The operating parameters of syrup softening unit 46 may vary depending on various processing factors, such as the flow rate and composition of the syrup from fluid line 44. Examples of suitable operating parameters for syrup softening unit 46 using a weak cation softener include a bed exhaustion rate of about three bv/hr, with an exhaustion temperature of about 85° C., and with a first regenerant of a 4% hydrochloric acid (HCl) solution in water with a first suitable regenerant temperature (e.g., from about 25° C. to about 75° C.), and first regenerant rate of about three bv/hr; and a second regenerant of a 4% sodium hydroxide (NaOH) solution in water with a second suitable regenerant temperature (e.g., from about 25° C. to about 75° C.), and second regenerant rate of about three bv/hr. Examples of suitable weak cation resins include those commercially available under the trade name "LANXESS" S 8528" from Lanxess Corporation, Birmingham, N.J.; and similar ion exchange resin products.

Examples of suitable operating parameters for syrup softening unit 46 using a strong cation softener include a bed exhaustion rate of about two bv/hr, with an exhaustion temperature of about 85° C., and with a regenerant of a 10% sodium chloride (NaCl) solution in water with a suitable regenerant temperature (e.g., from about 25° C. to about 75° C.). Examples of suitable strong cation resins include those commercially available under the trade names "DOWEX MARATHON" and "DOWEX MONOSPHERE" from The Dow Chemical Company, Midland, Mich.; and similar ion exchange resin products.

The softened syrup then travels from syrup softening unit 46 to chromatography unit 48 through fluid line 50. Chromatography unit 48 is a series of chromatography columns configured to reduce the invert, salts, and color level in the softened syrup, and to recycle the resulting low-invert sucrose product to the front end of system 10, such as to melter 16, through recycle line 52. The use of syrup softening unit 46 and chromatography unit 48 precludes the need for a conventional recovery house, which, as discussed above, typically uses an energy and equipment-intensive process.

Chromatography unit 48 utilizes cation ion exchange resin and is dependent upon a size exclusion mechanism. Smaller invert compounds, such as glucose and fructose, are preferentially adsorbed as the syrup passes through the resin thus resulting in a differential migration of the invert and desired sucrose (i.e., the invert lags behind). The invert can therefore be recovered as a separate fraction from the sucrose fraction.

Suitable types of chromatography appropriate for chromatography unit 48 include continuous simulated moving bed ("SMB") operations, time variable SMB operations, semi-continuous SMB operations, sequential SMB operations, and pulsed SMB operations. Examples of SMB processes are disclosed, for instance, in U.S. Pat. No. 6,379,554 (method of displacement chromatography); U.S. Pat. No. 5,102,553 (time variable simulated moving bed process), U.S. Pat. No. 6,093,326 (single train, sequential simulated moving bed process); and U.S. Pat. No. 6,187,204 (same), each of which is incorporated by reference herein in its entirety. While batch chromatography may alternatively be used for this step, it is generally recognized as less efficient with respect to eluent use and quantity of resin required compared with simulated moving bed type methods.

The number of columns or beds for chromatography unit 48 may vary depending on multiple factors, such as the composition and flow rate of the softened syrup from fluid line 50. Examples of suitable numbers of columns or beds for chromatography unit 48 range from one to eight. Examples of suitable cation chromatography resins include those commercially available under the trade name "DOWEX MONOSPHERE" from The Dow Chemical Company, Midland, Mich.; and under the trade names "1310" resins and "1320" resins from Rohm and Haas Company, Philadelphia, Pa.; those under the trade name "DIAION" from Mitsubishi Chemical Company, Tokyo, Japan; and similar ion exchange resin products.

The invert separated from the softened syrup may exit chromatography unit 48 via invert product line 54 for use in other processes, as desired. The resulting low-invert sucrose product may be recycled to the front end of system 10, such as to melter 16, through recycle line 52, as discussed above. This allows the low-invert sucrose product, which is also low in color and salt content, to be processed through system 10 again to recover additional amounts of sucrose, thereby increasing the amount of economically-valuable sucrose that is attained from system 10.

Figure 2:
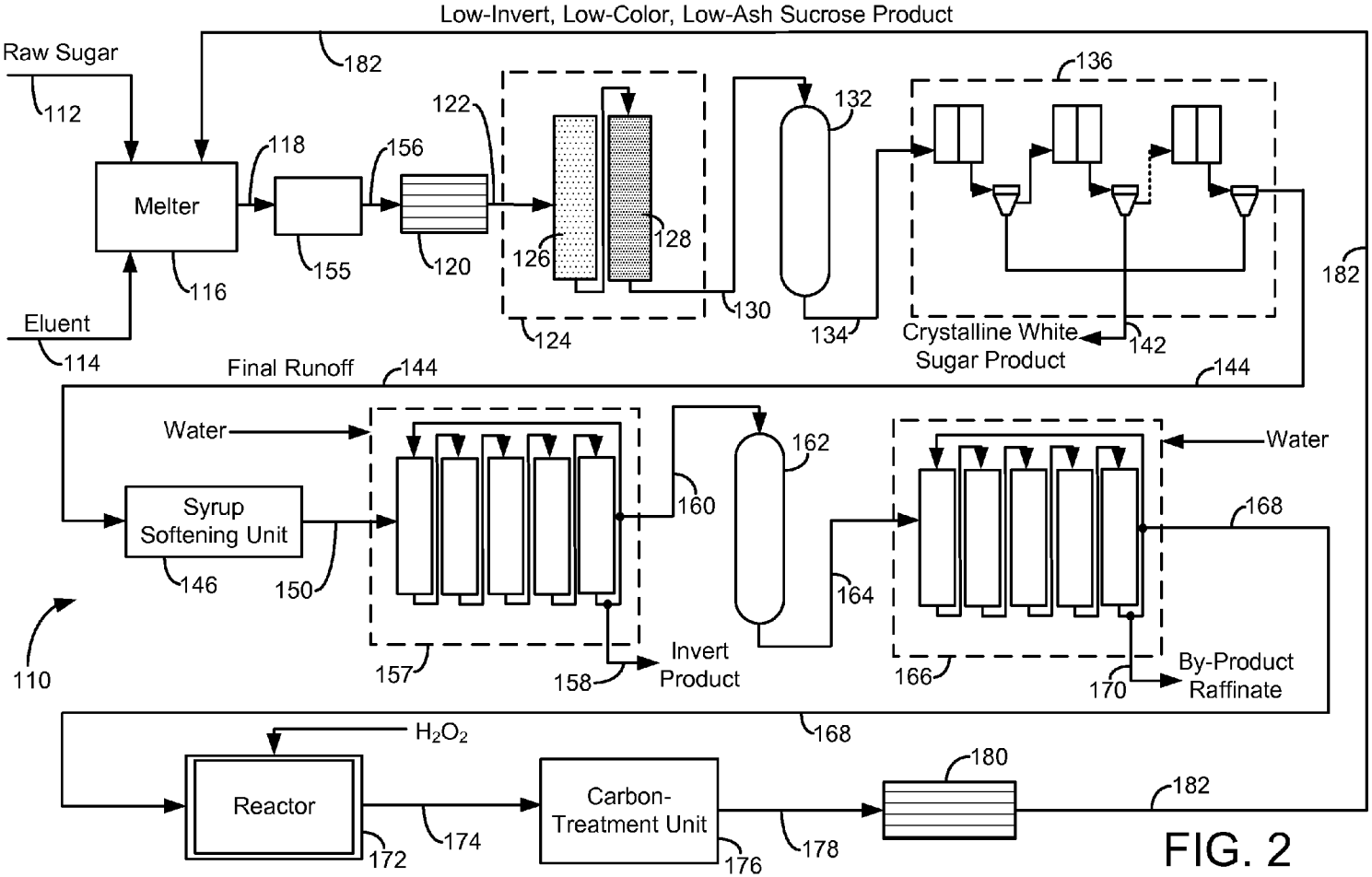
FIG. 2 is a block diagram of an alternative raw sugar refining system of the present disclosure.

FIG. 2 illustrates system 110 for producing high-quality sucrose with high levels of recovery from raw sugar, which is an alternative to system 10 (shown in FIG. 1), and where corresponding reference numbers are increased by "100". As shown in FIG. 2, system 110 adds to the efficiency of system 10 by incorporating additional clean-up steps to the ion exchange/chromatography combination. This can be useful if the raw sugar is difficult to process to acceptable quality. Since raw sugar can often be delivered to a refinery with unpredictable characteristics, system 110 is a preferred process in most cases to ensure a continuous high-quality sucrose product.

System 110 includes raw sugar line 112, eluent line 114, melter 116, fluid line 118, filter unit 120, fluid line 122, ion exchange decolorization unit 124, fluid line 130, evaporation system 132, fluid line 134, crystallization/centrifugation unit 136, product line 142, fluid line 144, syrup softening unit 146, and fluid line 150, each of which may function in the same manner as discussed above for the respective components of system 10 to produce the desired crystalline white sugar product at line 142 and the softened syrup at fluid line 150.

System 110 may also include clarification unit 155 and fluid line 156, located between fluid line 118 and filter 120. Clarification unit 155 is configured to clarify the melt liquor, and may include a phosphation/clarification process. After exiting clarification unit 155, the clarified melt liquor may enter filter unit 120 via fluid line 156. The clarified and filtered melt liquor may then proceed through the above-discussed units to produce the desired crystalline white sugar product at line 142 and the softened syrup at fluid line 150.

The softened syrup then travels through fluid line 150 from syrup softening unit 146 to first-loop chromatography unit 157. First-loop chromatography unit 157 may function in the same manner to chromatography unit 48 to reduce the levels of invert, color, and salts in the product syrup. Accordingly, first-loop chromatography unit 157 is used for the primary separation of the invert compounds from the softened syrup. The invert separated from the softened syrup may exit chromatography unit 157 via invert product line 158 for use in other processes, as desired.

The resulting low-invert or intermediate sucrose product may be directed through fluid line 160 to a second evaporation system 162, which is configured to increase the solids concentration of the solids in the low-invert sucrose product by boiling off a portion of the eluent. The resulting concentrated sucrose product that exits evaporation system 162 through fluid line 164 may have dry solids concentration ranging from about 50% by weight to about 70% by weight.

The concentrated sucrose product is then fed to second-loop chromatography unit 166. Second-loop chromatography unit 166 may also function in the same manner to chromatography unit 48 to further reduce the levels of invert, color, and salts in the product syrup. The extract or upgrade syrup that exits second-loop chromatography unit 166 through fluid line 168 is a high-purity extract containing primarily sucrose. In comparison, the second by-product raffinate that exits second-loop chromatography unit 166 through raffinate line 170 primarily contains salts, color, and high-molecular weight compounds.

The upgrade syrup traveling through fluid line 168 may be optionally subjected to further color elimination, de-odorizing, and sterilization using a hydrogen peroxide/carbon step. For example, the upgrade syrup traveling through fluid line 168 may be fed to reactor 172, where hydrogen peroxide ($H_2O_2$) is added to the upgrade syrup and allowed to react for a period of time (e.g., about 30 minutes).

Following the hydrogen peroxide reaction in reactor 172, the upgrade syrup may travel through fluid line 174 to carbon-treatment unit 176. In carbon-treatment unit 176, carbon is used to catalyze the elimination of remaining peroxide, if necessary, and also remove additional color and odor. The carbon can be added as powdered activated carbon (PAC) and then filtered, or the syrup can be passed through a bed of granulated activated carbon (GAC). Typical hydrogen peroxide addition levels are 100 to 500 parts-per-million (ppm) $H_2O_2$ on dissolved solids. Higher levels are appropriate for material exhibiting higher color and/or odor. Typical carbon addition levels range from about 0.001 grams per gram dissolved solids to about 0.005 grams per gram dissolved solids. Again, the higher levels are appropriate when color and odor are high.

If the decolorization/deodorizing effect of carbon is not needed, the residual hydrogen peroxide can be removed, if necessary, using a catalase enzyme, which provides a catalytic removal of the peroxide. After exiting carbon-treatment unit 176 through fluid line 178, the resulting upgrade syrup may be filtered in filter unit 180 to remove any residual carbon from the upgrade syrup.

The resulting low-invert sucrose product may be recycled to the front end of system 110, such as to melter 116, through recycle line 182. This allows the low-invert sucrose product, which is also low in color, salt content, and ash content to be processed through system 110 again to recover additional amounts of sucrose, thereby increasing the amount of economically-valuable sucrose that is attained from system 110.

Systems 10 and 110 may also include one or more process components that can be used to improve the efficiency of the ion exchange and chromatography steps, such as the shallow bed fractal technology as disclosed in U.S. Pat. No. 7,390,408, which is incorporated by reference herein in its entirety. This method, although not necessary to the functionality of systems 10 and 110, generally will provide additional benefits with respect to reduced capital costs, improved product quality, and reduced water use.

Although the present disclosure has been described with reference to preferred embodiments, workers skilled in the art will recognize that changes may be made in form and detail without departing from the spirit and scope of the disclosure.

The invention claimed is:

1. A system for refining raw sugar, the system comprising:
- a melting unit configured to receive the raw sugar and an eluent to produce a melt liquor;
- a decolorization unit configured to receive the melt liquor and to produce a fine liquor;
- a crystallization unit configured to fractionate high-purity crystalline sucrose from the fine liquor and to provide a run-off syrup;
- a softening unit configured to receive the run-off syrup to produce a softened syrup;
- at least one separation unit configured to receive the softened syrup to produce a low-invert sucrose product; and
- a recycle line configured to relay the low-invert sucrose product from the at least one separation unit to the melting unit.

2. The system of claim 1, wherein the at least one separation unit comprises a series of chromatography columns configured to receive the softened syrup and to fractionate at least a portion of the invert compounds from the received softened syrup.

3. The system of claim 1, wherein the at least one separation unit comprises:
- a first series of chromatography columns configured to receive the softened syrup and to produce an intermediate sucrose product;
- a concentrator unit configured to increase a solids concentration in the intermediate sucrose product to produce a concentrated sucrose product; and
- a second series of chromatography columns configured to receive the concentrated sucrose product and to produce the low-invert sucrose product.

4. The system of claim 3, and further comprising:
- a hydrogen peroxide reactor configured to receive the low-invert sucrose product from the second series of chromatography columns;
- a carbon-treatment unit disposed downstream from the hydrogen peroxide reactor; and
- a filtration unit disposed downstream from the carbon-treatment unit and upstream from the recycle line.

5. The system of claim 3, and further comprising a raffinate line connected to one of the second series of chromatography columns, wherein the second series of chromatography columns are further configured to produce a by-product raffinate from the concentrated upgrade syrup and provide the by-product raffinate to the raffinate line.

6. The system of claim 1, wherein the crystallization unit comprises a series of vacuum pans and centrifugation units.

7. The system of claim 1, wherein the run-off syrup provided by the crystallization unit comprises invert compounds, non-fractionated sucrose, and divalent cations.

8. A system for refining raw sugar, the system comprising:
- a melting unit configured to receive the raw sugar and an eluent to produce a melt liquor;
- a first unit configured to receive the melt liquor and to produce a fine liquor;
- a crystallization unit configured to fractionate high-purity crystalline sucrose from the fine liquor and to provide a run-off syrup comprising invert compounds, non-fractionated sucrose, and divalent cations;
- a second unit configured to receive the run-off syrup and to remove at least a portion of the divalent cations from the run-off syrup to produce a softened syrup;
- at least one separation unit configured to receive the softened syrup and to fractionate at least a portion of the invert compounds from the received softened syrup to produce a low-invert sucrose product; and
- a recycle line configured to relay the low-invert sucrose product from the at least one separation unit to the melting unit.

9. The system of claim 8, and further comprising an invert product line, wherein the at least one separation unit is further configured to provide the fractionate portion of the invert compounds to the invert product line.

10. The system of claim 8, wherein the at least one separation unit comprises:
- a first series of chromatography columns configured to receive the softened syrup and to produce an intermediate sucrose product;
- a concentrator unit configured to increase a solids concentration in the intermediate sucrose product to produce a concentrated sucrose product; and
- a second series of chromatography columns configured to receive the concentrated sucrose product and to produce the low-invert sucrose product.

11. The system of claim 10, and further comprising:
- a hydrogen peroxide reactor configured to receive the low-invert sucrose product from the second series of chromatography columns;

a carbon-treatment unit disposed downstream from the hydrogen peroxide reactor; and a filtration unit disposed downstream from the carbon-treatment unit and upstream from the recycle line.

12. The system of claim 10, wherein the concentrator unit comprises an evaporation system.

13. The system of claim 10, wherein the concentrated sucrose product produced by the concentrator unit has a dry solids concentration ranging from about 50% by weight to about 70% by weight.

14. The system of claim 8, wherein the crystallization unit comprises a series of vacuum pans and centrifugation units.

15. A method for refining raw sugar, the method comprising:

combining the raw sugar and an eluent to produce a melt liquor having a color level;

reducing the color level of the melt liquor to produce a fine liquor;

fractionating sucrose from the fine liquor to produce high-purity crystalline sucrose and a run-off syrup;

removing at least a portion of divalent cations from the run-off syrup to produce a softened syrup;

removing at least a portion of invert compounds from the softened syrup using a differential migration through an ion exchange resin to produce a low-invert sucrose product an invert compounds; and combining the low-invert sucrose product with subsequent amounts of the raw sugar and the eluent.

16. The method of claim 15, wherein removing at least a portion of the invert compounds from the softened syrup comprises:

feeding the softened syrup through a first series of chromatography columns to produce an intermediate sucrose product;

increasing the solids concentration in the intermediate sucrose product to produce a concentrated sucrose product; and feeding the concentrated sucrose product through a second series of chromatography columns to produce the low-invert sucrose product.

17. The method of claim 16, and further comprising:

reacting the low-invert sucrose product produced from the second series of chromatography columns with hydrogen peroxide;

treating the reacted low-invert sucrose product with carbon; and filtering the treated low-invert sucrose product.

18. The method of claim 16, and further comprising removing at least a portion of a by-product raffinate from the second series of chromatography columns.

19. The method of claim 16, wherein increasing the solids concentration in the intermediate sucrose product to produce the concentrated sucrose product comprises evaporating a portion of the eluent such that the concentrated sucrose product has a dry solids concentration ranging from about 50% by weight to about 70% by weight.

20. The method of claim 15, wherein fractionating the sucrose from the fine liquor to produce the high-purity crystalline sucrose and the run-off syrup comprises crystallizing and separating the high-purity crystalline sucrose in a multiple-strike unit.

* * * * *